US008328206B2

(12) United States Patent
Williams, Jr.

(10) Patent No.: US 8,328,206 B2
(45) Date of Patent: Dec. 11, 2012

(54) SKATEBOARD TRUCK WITH ROTATEABLE WING SHAPED BUSHING

(76) Inventor: Alfred C. Williams, Jr., San Francisco, CA (US)

( * ) Notice: Subject to any disclaimer, the term of this patent is extended or adjusted under 35 U.S.C. 154(b) by 444 days.

(21) Appl. No.: 12/715,138

(22) Filed: Mar. 1, 2010

(65) Prior Publication Data

US 2011/0210526 A1 Sep. 1, 2011

(51) Int. Cl.
*A63C 17/00* (2006.01)

(52) U.S. Cl. ..... 280/11.28; 280/87.042; 280/11.27

(58) Field of Classification Search ..... 280/87.01, 280/87.041, 87.042, 11.27, 11.28
See application file for complete search history.

(56) References Cited

U.S. PATENT DOCUMENTS 4,047,725 A * 9/1977 Pinchock ..... 280/11.28
4,071,256 A 1/1978 Kimmell
4,084,831 A 4/1978 Akonteh et al.
4,103,917 A 8/1978 Widolf
4,109,925 A 8/1978 Williams et al.
4,125,268 A 11/1978 Varner
4,180,278 A 12/1979 Gottlieb
4,251,087 A * 2/1981 Hansen ..... 280/11.28
4,311,319 A * 1/1982 Snyder et al. ..... 280/11.28
4,645,223 A 2/1987 Grossman
4,930,794 A 6/1990 Chan
5,971,411 A 10/1999 Jones
6,315,304 B1 * 11/2001 Kirkland et al. ..... 280/11.28
6,315,312 B1 * 11/2001 Reyes et al. ..... 280/87.042
6,428,023 B2 * 8/2002 Reyes et al. ..... 280/87.042
6,443,471 B1 9/2002 Mullen
6,467,782 B1 * 10/2002 Smith ..... 280/87.042
6,474,666 B1 11/2002 Andersen
6,523,837 B2 * 2/2003 Kirkland ..... 280/11.28
6,547,262 B1 4/2003 Yamada
6,793,224 B2 9/2004 Stratton
7,007,957 B1 * 3/2006 Lee ..... 280/11.28
7,080,845 B2 7/2006 Inchley
7,093,842 B2 8/2006 Chmelar
7,150,460 B2 12/2006 Williams
7,219,907 B2 * 5/2007 Chang ..... 280/87.042
7,316,408 B2 1/2008 McClain
7,413,200 B2 * 8/2008 Horn ..... 280/87.042
8,152,176 B2 * 4/2012 Wilson et al. ..... 280/11.27
2002/0011713 A1 * 1/2002 Kirkland ..... 280/11.28
2005/0167938 A1 * 8/2005 Chung et al. ..... 280/87.042
2006/0097470 A1 * 5/2006 Chmelar ..... 280/87.042
2007/0164530 A1 * 7/2007 Horn ..... 280/87.042
2010/0327547 A1 * 12/2010 Wilson et al. ..... 280/87.042
2011/0148055 A1 * 6/2011 Visinski et al. ..... 280/11.27

* cited by examiner

*Primary Examiner* — Hau Phan
*Assistant Examiner* — Jacob Meyer
(74) *Attorney, Agent, or Firm* — Jon Fallon, Esq.; Mandelbaum Salsburg

(57) ABSTRACT

A skateboard truck is fabricated utilizing one, or more, elongated, generally 'wing' shaped, elastomeric bushings which have the ability of being controllably rotated both from within, as well as from around, the perimeters of one or more bushing seats formed into the main body of the hanger of the skateboard truck. By controllably rotating the wing shaped bushing from a parallel bushing position in relation to the sloped mounting face of the truck base plate into a perpendicular bushing position in relation to the same sloped mounting face, an enhanced range of truck tension control options are provided to the truck. Such a truck design permits the possibility of bushing tension and position adjustments to be made to the truck without the need for the rider to dismount the skateboard, and also without the use of tools. Moreover, a skateboard rider has the ability to perform such truck tension adjustments while being mounted on and in the act of riding the skateboard.

20 Claims, 9 Drawing Sheets

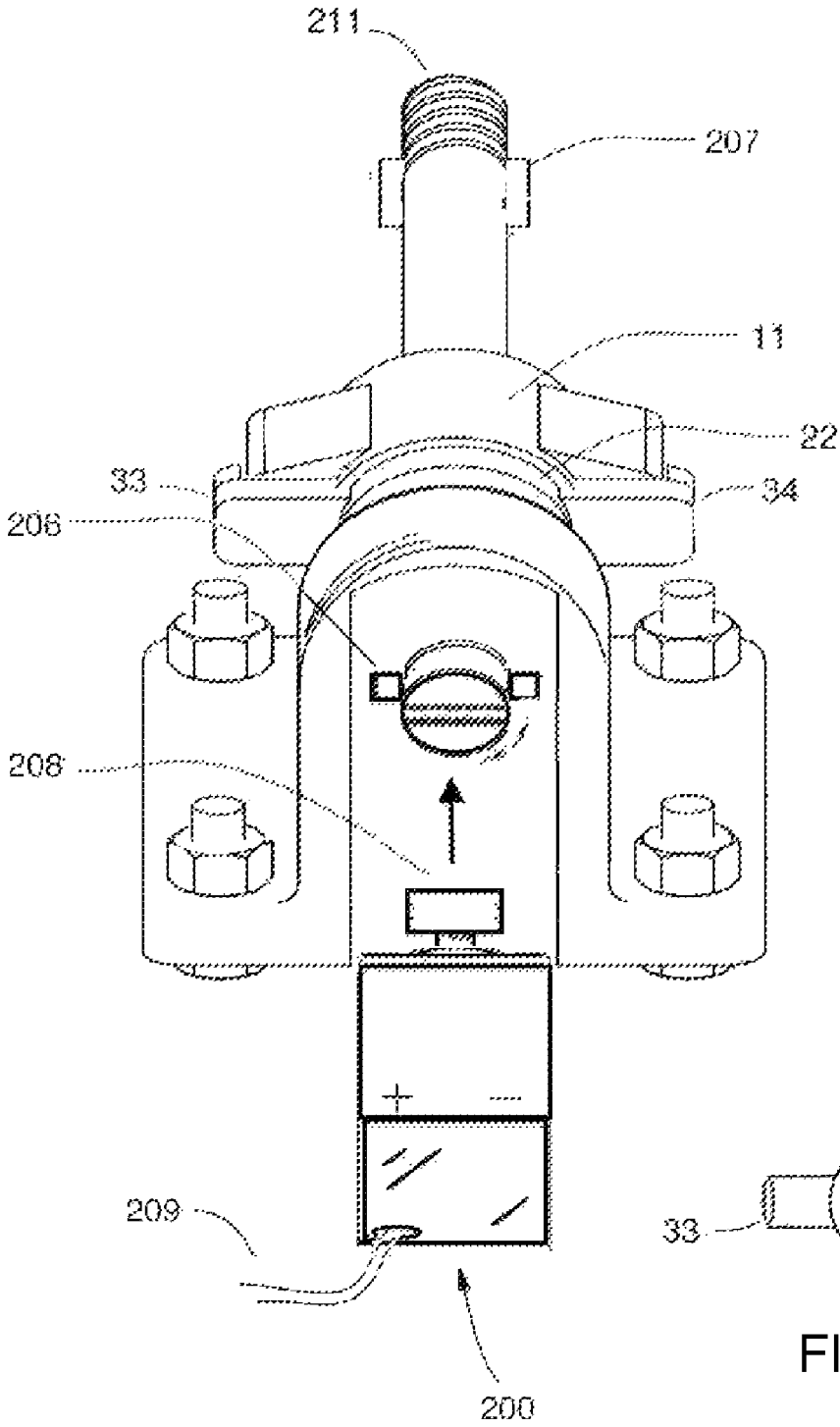
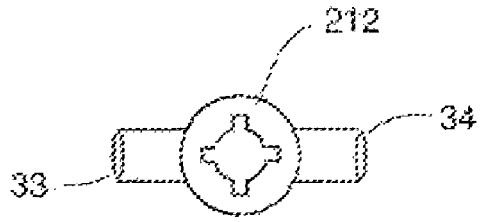
FIG. 8A
FIG. 8

SKATEBOARD TRUCK WITH ROTATEABLE WING SHAPED BUSHING

FIELD OF THE INVENTION

The invention broadly relates to skateboards. More specifically, the invention relates to an adjustable truck assembly for skateboards to provide an increased and decreased roll resistance according to desired skateboard stability and performance characteristics.

BACKGROUND OF THE INVENTION

A skateboard is comprised of an elongated board with a pair of trucks attached underneath. Each truck is comprised of a base plate that is attached to the board with mounting bolts, and a hanger that is attached to the base plate with a king pin bolt. The hanger has two lateral arms through which an axle is embedded. The hanger has an upwardly projecting pivot pin which is positioned inside a pivot pin receiving hole in the base plate. The king pin bolt is positioned through an oversized hole in a main body portion of the hanger. The bolt is centered within the hole by two flat bottomed, elastomeric bushings each seated in a shallow, cylindrical shaped bushing seat on either side of the hanger. The king pin bolt and the pivot pin form a divergent angle in the direction towards the board. When the board is rolled about a longitudinal axis to either side by foot pressure, the hanger is pivoted about the pivot pin to steer the wheels in a corresponding direction. The trucks are mounted as mirror images of each other, so that they simultaneously steer in opposite directions in response to board roll.

The elastomeric bushings provide compliance to enable the bolt to move laterally within the oversized hole in the bushing seats, and to provide increasing roll resistance with increasing roll angle of the board. Roll resistance is determined by the size, shape, hardness and positioning of the elastomeric bushings, and also by the clamping force applied on the bushings by the bolt, which is adjustable for tuning bushing compression and board roll resistance. The bushings must provide enough resistance to prevent the wheels from steering too easily, that is, to provide suitable directional stability. Higher resistance provides good directional stability but limits turning radius, whereas lower resistance enables a tight turning radius but sacrifices some directional stability.

Currently, prior art skate technology does not provide a quick or efficient method of making bushing tension or bushing position adjustments on a skateboard truck. For bushing tensioning purposes, current adjustment procedures demand that a rider dismount and turn over the skateboard, and then use tools such as a wrench, allen key or skate tool to effect such tensioning adjustments. As for bushing position adjustments, prior art currently provides only for the replacement of one bushing with another, and doesn't address the many benefits to be found by controllably rotating the position of the bushings, within their respective bushing seats, on the truck itself. This limitation is largely due to the fact that current skate technology predominantly uses flat bottomed, cylindrical shaped skateboard bushings wherein the act of rotating such bushings within their corresponding bushing seats provides little or no functional benefit to the operation of a skateboard.

Other bushing shapes, uncommon as they are, utilize bushings in a fixed position, presumably to gain the most rebound or 'return to center' from the bushings, or else, to obviate the need for the use of a pivot pin in the truck mechanism for the controlled turning of the skateboard. For example, U.S. Pat. No. 6,523,837 to Kirkland (and related U.S. Pat. No. 6,315,304 to Kirkland et al.) discloses a skateboard truck having an adjustment ring which is used to manually rotate a cam surface adjacent one end of a bushing. Mating cam surfaces in the hanger act to compress/decompress the bushing when the adjustment ring is rotated.

It would thus be desirable to provide a truck bushing and a method of easily controlling the rotation of the truck bushing so as to quickly and without the use of tools facilitate a change in the desired roll resistance of the truck relative to the board and thus provide increased control over the steering and handling characteristics of the skateboard.

SUMMARY OF THE INVENTION

Wherefore, it is an object of the present invention to overcome the aforementioned problems and drawbacks associated with the skateboard bushings currently known in the prior art.

Generally, the present invention relates to a skateboard truck having a baseplate, a hanger, a bushing between the baseplate and the hanger, and a king pin passing through and connecting the baseplate, the bushing and the hanger, with the bushing being controllably rotatable between two positions corresponding to different suspension settings, one being relatively stiff and the other relatively soft.

The skateboard truck is fabricated utilizing one, or more, elongated, generally 'wing' shaped, elastomeric bushings which have the ability of being controllably rotated from within one or more bushing seats formed into the main body of the hanger of the skateboard truck. When the two tips of an inner, wing shaped bushing are rotated into a parallel bushing position, in relation to the sloped mounting face of the truck baseplate, no surface area contact is made between the bushing tips and the two rigid sides of the main body portion of the hanger during the riding of the skateboard. With such a truck and bushing configuration a skateboard is capable of making very sharp turns during the course of riding but lacks some directional control and speed stability. However, when the same wing tips of the wing shaped bushing are manually, mechanically or electrically rotated by about 90 degrees, the bushing tips become newly directed into a perpendicular bushing position in relation to the sloped mounting face of the truck baseplate. This new bushing direction places the tips into a position wherein they make significant surface area contact with the two sides of the main body of the truck hanger. This newly provided surface contact acts to resist to a greater degree the leveraged forces applied to the bushings during skateboard turning, such that the truck during riding is much more directionally stable and capable of being used for higher speed skateboard riding purposes.

An elongated, generally 'wing' shaped, notched washer can also be mounted directly beneath the above mentioned wing shaped bushing, such that the wing shaped washer is both positioned in a corresponding direction with, and rotated in conjunction with, the above said wing shaped bushing. The wing shaped washer adds significant additional support, rigidity and strength to the elastomeric 'wing tips' of the wing shaped bushing when the bushing is rotated into the above said perpendicular bushing position. The wing shaped washer and wing shaped bushing can also be rotated easily by hand, or alternatively can be rotated by a mechanized, spring loaded or electric control switch assembly attached to a freely rotating king pin stud, the stud engaging the wing shaped washer and wing shaped bushing when needed. The mechanized, spring loaded or electric control switch can be activated by the rider of the skateboard by means of an access hole, or cut out, incorporated into the deck of the skateboard, making truck bushing adjustments on the truck to be possible while a rider is mounted on and in the act of riding the skateboard.

The invention also relates to a skateboard truck for use in connection with a skateboard, the skateboard truck comprising a baseplate, a hanger and a bushing arranged between the baseplate and the hanger to provide a relative spring bias suspension between the hanger and baseplate, a pin for securing the relative arrangement of the baseplate, bushing and hanger, and the bushing is controllably rotatable between a first and a second position defining different suspension characteristics between the baseplate and the hanger; and wherein in one of the first and second positions the bushing applies a greater resistance against relative movement between the hanger and baseplate than in the other position.

The invention further relates to a method of adjusting the stiffness of a skateboard suspension comprising the steps of arranging a bushing between a baseplate and a hanger to provide a relative spring bias suspension between the hanger and baseplate, securing the relative arrangement of the baseplate, bushing and hanger with a pin; and controllably rotating the bushing between a first and a second position defining different suspension characteristics between the baseplate and the hanger; and applying in one of the first and second positions of the bushing a greater resistance against relative movement between the hanger and baseplate than in the other position.

These and other features, advantages and improvements according to this invention will be better understood by reference to the following detailed description and accompanying drawings.

BRIEF DESCRIPTION OF THE DRAWINGS

The invention will now be described, by way of example, with reference to the accompanying drawings in which:

FIG. 8 is a bottom perspective view of a novel truck baseplate, detailing an alternative embodiment that is configured to incorporate an electro-mechanical device for the purpose of controllably rotating the wing shaped bushing of the novel truck.

FIG. 8A details a different embodiment of winged washer incorporating bent tips and multiple hole indentations;

DETAILED DESCRIPTION OF THE INVENTION

Figure 1A:
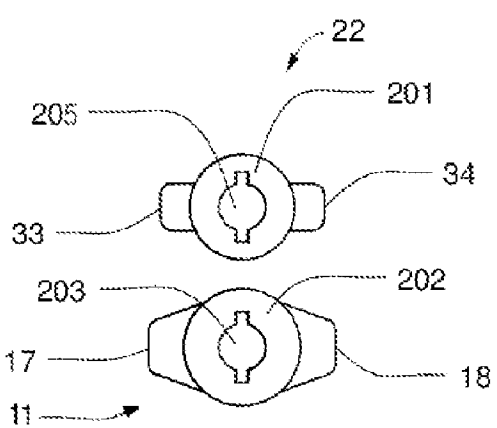
FIG. 1A is a planar view of an embodiment of type of wing shaped bushing and notched, wing shaped washer.
Figure 1:
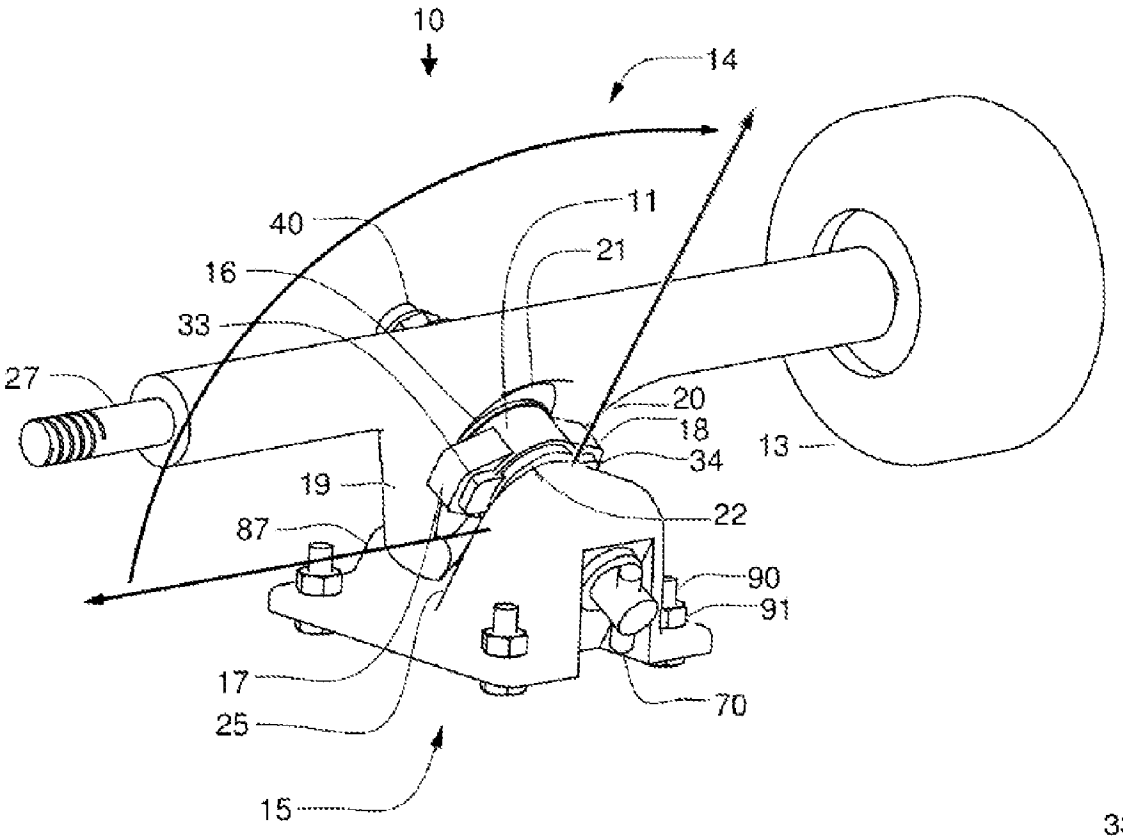
FIG. 1 is a perspective view of an embodiment of a novel skateboard truck having the tips of a wing shaped bushing and the tips of a wing shaped washer directed into a perpendicular bushing engagement position in relation to the sloped mounting face of the truck baseplate.

Turning now to FIG. 1, the present invention relates to a skateboard truck of the present invention. A skateboard truck 10 shown in FIG. 1 is arranged such that an elongated, generally wing shaped, elastomeric, inner bushing 11 is positioned between a hanger 14 and a baseplate 15 of the truck 10, the inner bushing 11 having the capability of being controllably rotated both from within, as well as from around, the perimeter of an inner bushing seat 16 recessed into a main body 21 of hanger 14.

Figure 3:
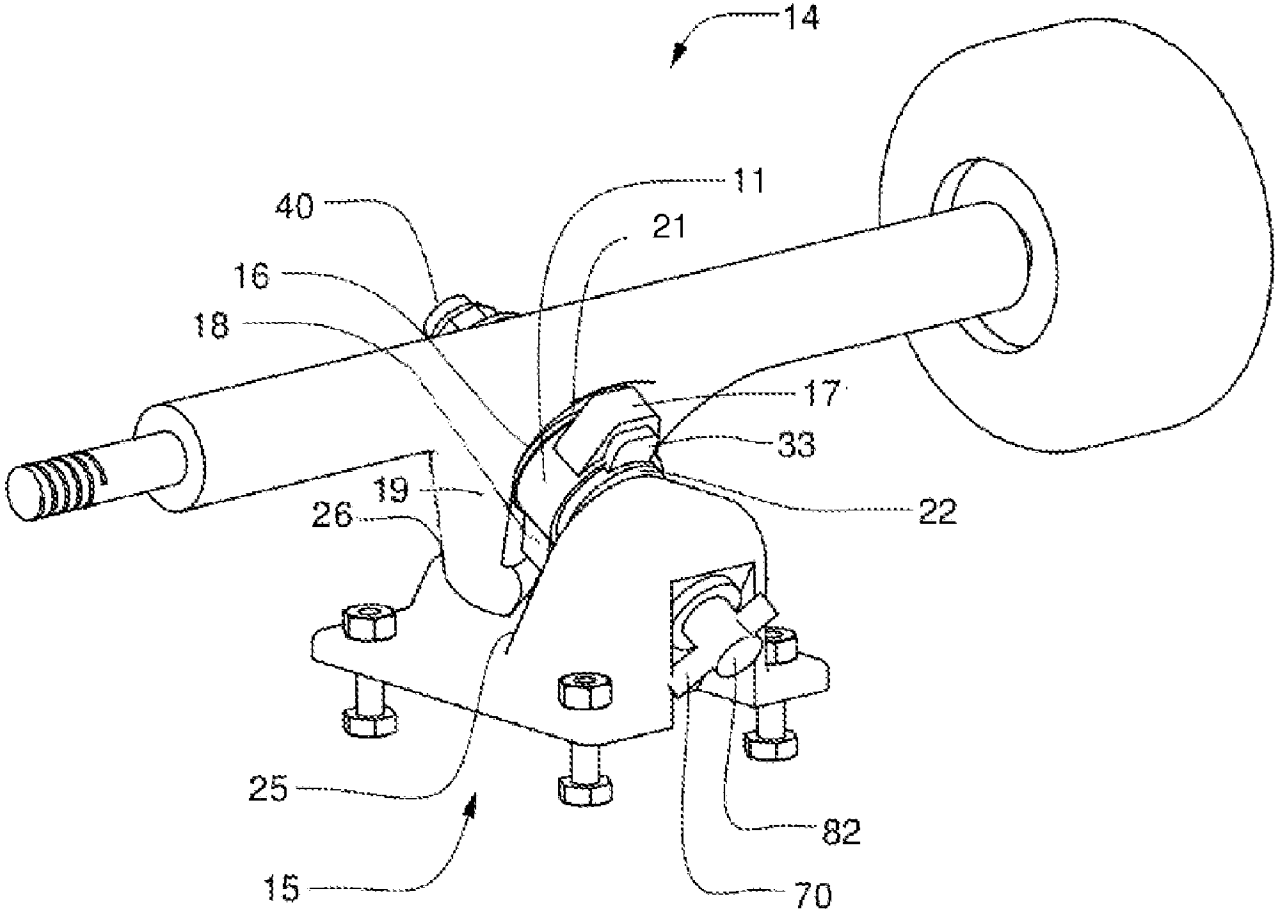
FIG. 3 is a perspective view of the first embodiment of the novel skateboard truck having the tips of a wing shaped bushing and the tips of a wing shaped washer directed into a parallel bushing non-engaged position in relation to the sloped mounting face of the truck baseplate.

When the two tips 17 & 18 of the wing shaped bushing 11 are set into a parallel bushing position, as shown in FIG. 3, in relation to the direction of the sloped mounting face 25 of the baseplate 15, the two bushing tips 17 & 18 are positioned such that the two rigid sides 19 & 20 of the main body 21 of hanger 14 make no surface area contact or little to no compressional contact with the bushing tips 17 & 18 during skateboard riding and turning. In other words, the bushing tips 17 & 18 have little to no influence on the roll and turnability of the hanger 14 relative to the baseplate 15. This parallel bushing positioning (FIG. 3) where the bushing tips 17, 18 are substantially non-engaged with the hanger permits the truck 10 to make very sharp radius turns during skateboard riding, but at the same time limits some directional control and high speed riding stability.

However, when the same wing tips 17 & 18 and the wing shaped inner bushing 11 are manually, mechanically, or electrically rotated by about 90 degrees, the same wing tips 17 & 18 become newly positioned into a perpendicular and a substantially engaged bushing position as illustrated in FIG. 1, in relation to the sloped mounting face 25 of the baseplate 15. This newly directed positioning places the two bushing tips 17 & 18 into a position wherein they make significant surface area and compressional contact with the two rigid side portions 19 & 20 of the main body 21 of the hanger 14. The significantly increased surface area, and compressional, contact made between the rigid sides 19 & 20 and the wing shaped bushing tips 17 & 18 acts to significantly resist the leveraged forces applied to the wing shaped bushing 11 by the hanger 14 during skateboard riding and turning.

A truck and bushing system configured in the perpendicular engaged bushing position FIG. 1 therefore becomes much more directionally stable, and so becomes more suitable to be used for higher speed skateboard riding purposes. Additional fine tuning of the bushing tension can be affected by 'normal' truck adjustment procedures, that is, by the tightening or loosening of the adjustment nut 43 on the threaded end 36 (not shown) of the king pin stud 40.

The inner bushing seat 16 is formed by a recessed area in the main body 21 of the hanger 14, with opposing raised perimeter regions of the bushing seat 16 being formed by the side portions 19 & 20 of the main body 21 of the hanger. The overall shape of the bushing 11, while shown in FIG. 1A as a generally cylindrical central body having oppositely extending bushing tips, can encompass other suitable shapes which can be rotated orthogonally between the engaged and non-engaged positions. For example, the bushing can be generally oval, rectangular, rhombus-shaped, compressed rhombus, or any of the above with rounded edges. The term "wing shaped" is intended to encompass each of these embodiments, and any shape essentially which includes a part, protrusion or protrusions which can be used to increase the surface area engagement between the bushing 11 and the hanger 14 by engaging a greater surface area of the hanger 14 in the engaged position as shown and described with respect to FIG. 1.

The bushing 11 illustrated in the figures has a central body with a pair of oppositely disposed bushing tips 17 & 18, the central body defining a rotating perimeter within the raised perimeter regions formed by the side portions 19 & 20 and the bushing tips 17 & 18 define a rotating perimeter greater than the raised perimeter regions formed by the side portions 19 & 20 of the main body 21 of hanger 14. The bushing seat 16 is defined within the main body 21 of hanger 14 and between the side portions 19, 20 of the hanger 14. The bushing seat 16 is shaped to accommodate the wing shaped bushing 11 and does not necessarily have to be recessed, but can also be formed planar or raised. When the bushing 11 is rotated to the engaged position shown in FIG. 1 (perpendicular), the bushing tips 17 & 18 extend beyond and engage the raised perimeter regions of the bushing seat 16 formed by the side portions 19 & 20 of the main body 21 of hanger 14. This arrangement increases the surface contact area between tips 17, 18 of wing shaped bushing 11 and the hanger providing more elastic bias and leveraged resistance against relative movement between the hanger and the baseplate 15, thus providing a stiffer suspension.

When the bushing 11 is rotated to the parallel non-engaged position shown in FIG. 3 the bushing wing tips 17 & 18 are directed in a position aligned substantially perpendicular to the axle shaft 27 and therefore, even if the tips 17, 18 did not become fully non-engaged with the hanger, i.e. they remained in surface contact to some extent with the top portion of the main body 21 of hanger 14, the roll or turnability of the hanger 14 relative to the baseplate 15 is still increased because in this position the hanger essentially rotates about an elongate centerline of the bushing 11 defined by the wings 17, 18. In other words, the wing tips 17, 18 would not be compressed against the raised perimeter regions formed by the side portions 19 & 20.

It is also to be appreciated that the bushing 11 could be reversed, i.e. flipped over, so that the wing tips 17, 18 bear to some extent on the baseplate 15 rather than the hanger 14. Although not a preferred embodiment, this arrangement would provide a similar variation in the suspension characteristics between the hanger and baseplate 15 so as to increase or decrease the elastic bias, i.e. resistance, between the hanger and baseplate. Also, the term "elastic" as used herein is generally used to mean a bias provided by a bushing fabricated from an elastomeric material. But the use of this term is also meant to be interchangeable with the term "spring" where an element other than an elastomeric polymer material is used for the bushing.

In an alternative embodiment, the bushing 11 could be a cylinder, or a conic section as known in the art having a portion of the bushing which is fabricated from a different material, for instance a harder durometer rubber or plastic with different elasticity i.e. spring and compression characteristics relative to other portions of the bushing. Also, a substantially cylindrical or conic section bushing as shown for example as bushing element 45 could be reinforced by a washer or another harder insert element, even a steel reinforcement element, to provide a difference in resistance between the first and second positions of the bushing relative to the movement permitted between the baseplate 15 and the hanger 14. In this way it is conceivable that the surface area of contact between the bushing 11 and the baseplate 15 and/or hanger 14 does not have to be increased. In other words, with essentially a harder and softer portion of the bushing where the bushing is controllably rotatable about the pin or alternatively with the pin between a first and a second position defining different suspension characteristics between the baseplate and the hanger, in one of the first and second positions the bushing applies a greater resistance against relative movement between the hanger and baseplate than in the other position.

A rigid, wing shaped, notched washer 22 can also be mounted directly beneath the above mentioned wing shaped bushing 11, such that the wing shaped washer 22 is positioned in a corresponding direction to, and has the ability of being rotated in conjunction with the wing shaped bushing 11. The rigid tips 33 and 34 of the wing shaped washer 22 add significant additional support, rigidity and strength to the elastomeric wing tips 17 & 18 of the wing shaped bushing 11 when both the bushing 11 and washer 22 are simultaneously rotated to the above described perpendicular bushing engaged position FIG. 1.

The wing shaped washer 22 and wing shaped bushing 11 can be rotated into the perpendicular bushing engaged position FIG. 1, or parallel bushing non-engaged position FIG. 3, easily by hand, without the need or use of tools. Alternatively, the wing shaped bushing 11 and wing shaped washer 22 can be rotated with the aid of a mechanical control switch assembly such as the spring loaded control switch assembly shown in FIG. 7, or with an electrical 'servo' motor switch assembly as shown in FIG. 8, the switch assemblies being attached to an end area 82 of rotatable king pin stud 40. The rotatable king pin stud 40 has the capability of incorporating various types of shallow gear drives such as 41 & 42, see FIG. 4, which drives have the ability of fitting into, and engaging, one or more shallow indentations 201 (FIG. 1A), incorporated into a through hole 205 of the wing washer 22 and/or the indentations 202 of the through hole 203 of the wing shaped bushing 11. The use of the various types of the control switch assemblies provides a means for the tool-less rotation of the wing shaped washer 22 and wing shaped bushing 11 when desired. Moreover, the various control switch assemblies are capable of being attached onto, or inserted into, the king pin stud 40 in such a way as to provide a means of making the control switch assemblies accessible for manipulation from the top of the skateboard deck 302, FIG. 6. An access hole, or 'drop through' cut out 305, incorporated into the deck 302 of the skateboard 300 makes the tensioning of the skateboard truck bushings possible while a rider is both mounted on, and in the act of, riding the skateboard. A ratchet, spring loaded, or lock and trigger assembly 312, illustrated in FIG. 6, can also be configured so as to be activated either automatically or manually when needed for the control and reduction of 'wheel wobble' that can occur during high speed skateboard riding. Alternatively a battery powered radio control switch can be utilized to activate the 'servo motor' 200 seen in FIG. 8. Other suitable motor types may also be utilized to activate and effect the remote control rotation of the king pin stud 40 inside baseplate 15 of skateboard truck 10.

Figure 2:
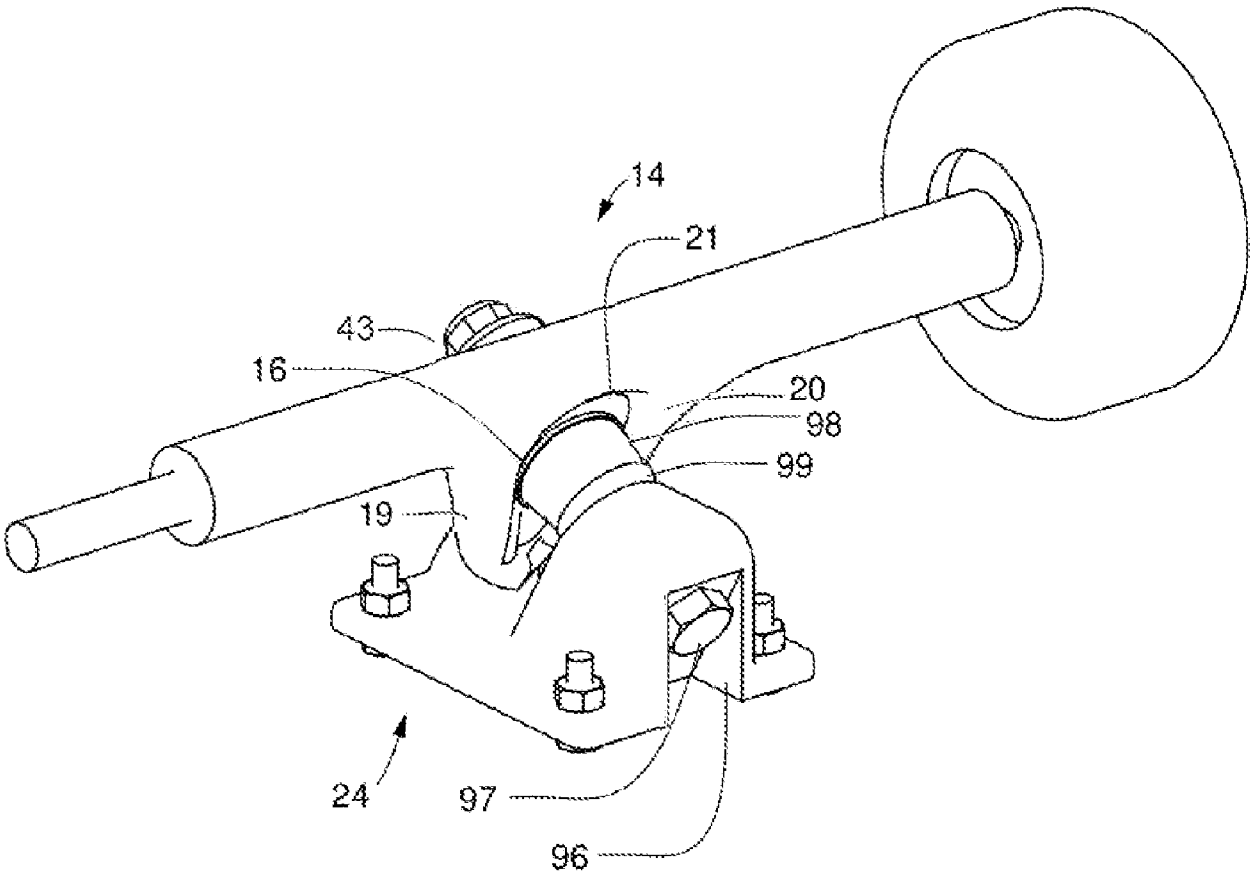
FIG. 2 (PRIOR ART)
FIG. 2 is a perspective view of a prior art skateboard truck showing a generally cylindrical shaped bushing that is seen to be positioned between the base plate and the hanger of the skateboard truck.

A prior art skateboard truck FIG. 2 is seen to be incorporated with a generally cylindrical shaped bushing 98, seated in between a shallow, generally cylindrical shaped bushing washer 99 and a shallow, generally cylindrical shaped bushing seat 16. Because the bushing 98 lacks 'wing' type protrusions there is no means provided for the bushing 98 to resist or block the leveraged forces of side portions 19 and 20 of main body 21 of the prior art hanger when the skateboard is being steered and in the act of turning. Furthermore, the main body 21 is formed as an opening recess such that the only surface area contact made between hanger 14 and bushing 98 during skateboard riding is made within the perimeter area of the shallow cylindrical shaped bushing seat 16 formed into the main body 21 of the prior art hanger.

On the prior art base plate 24, the hex head 97 of the king pin bolt is also seen to be installed into the base plate 24 such that the hex head is not capable of rotation due to the proximity of the hex head to the interior sides 96 of the baseplate 24. All tensioning adjustments to the bushing 98 of the prior art truck shown in FIG. 2 require the use of wrenches, ratchets, or other such tools to tighten the adjustment nut 43 on the threaded end of the king pin bolt.

FIG. 3 illustrates an embodiment of the invention wherein the wing shaped inner bushing 11 is shown to be positioned with wing tips 17 & 18 directed into a parallel non-engaged position in relation to the slope on the mounting face 25 on base plate 15. Wing shaped washer 22 is seen positioned below bushing 11 and is used to give support to the wing tips 17 and 18 of the bushing 11. The rigid tips 33 and 34 (not shown) of the washer 22 can be formed in different lengths and shapes for specific bushing support objectives.

A control lever switch 70 is seen to be inserted into an end portion 82 of rotatable king pin stud 40. This switch lever can be used to manipulate the wing shaped washer 22 and wing shaped bushing 11 from a position accessible from the top of the deck of a skateboard, as illustrated in FIG. 6.

Figure 4:
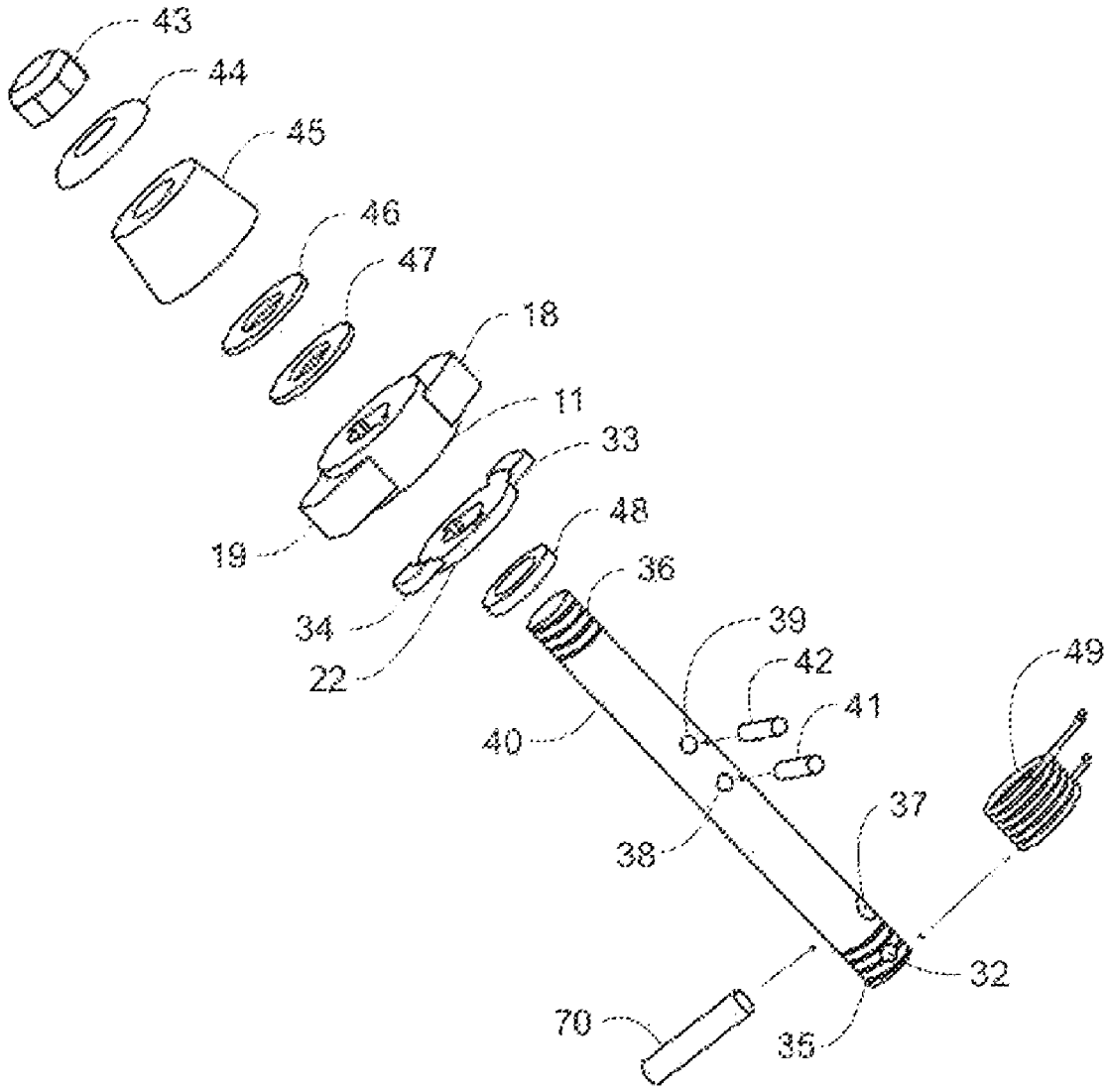
FIG. 4 is an exploded perspective view of a skate hardware configuration that can be utilized on the novel truck.

FIG. 4 is an exploded view of various hardware elements possible to be used in an embodiment of the novel skateboard truck 10 of the invention. Outer bushing 45 and retaining washer 44 can be substituted with a secondary wing shaped bushing 11, and secondary wing shaped washer 22 if needed for enhancing the directional stability of the novel truck. Additional types of drive gears such as 41 & 42 can be incorporated into the king pin stud 40 to drive and rotate the secondary wing shaped washer and secondary wing shaped bushing. Other gear drives or protrusions can also be used to effect such bushing and washer rotation.

Figure 5:
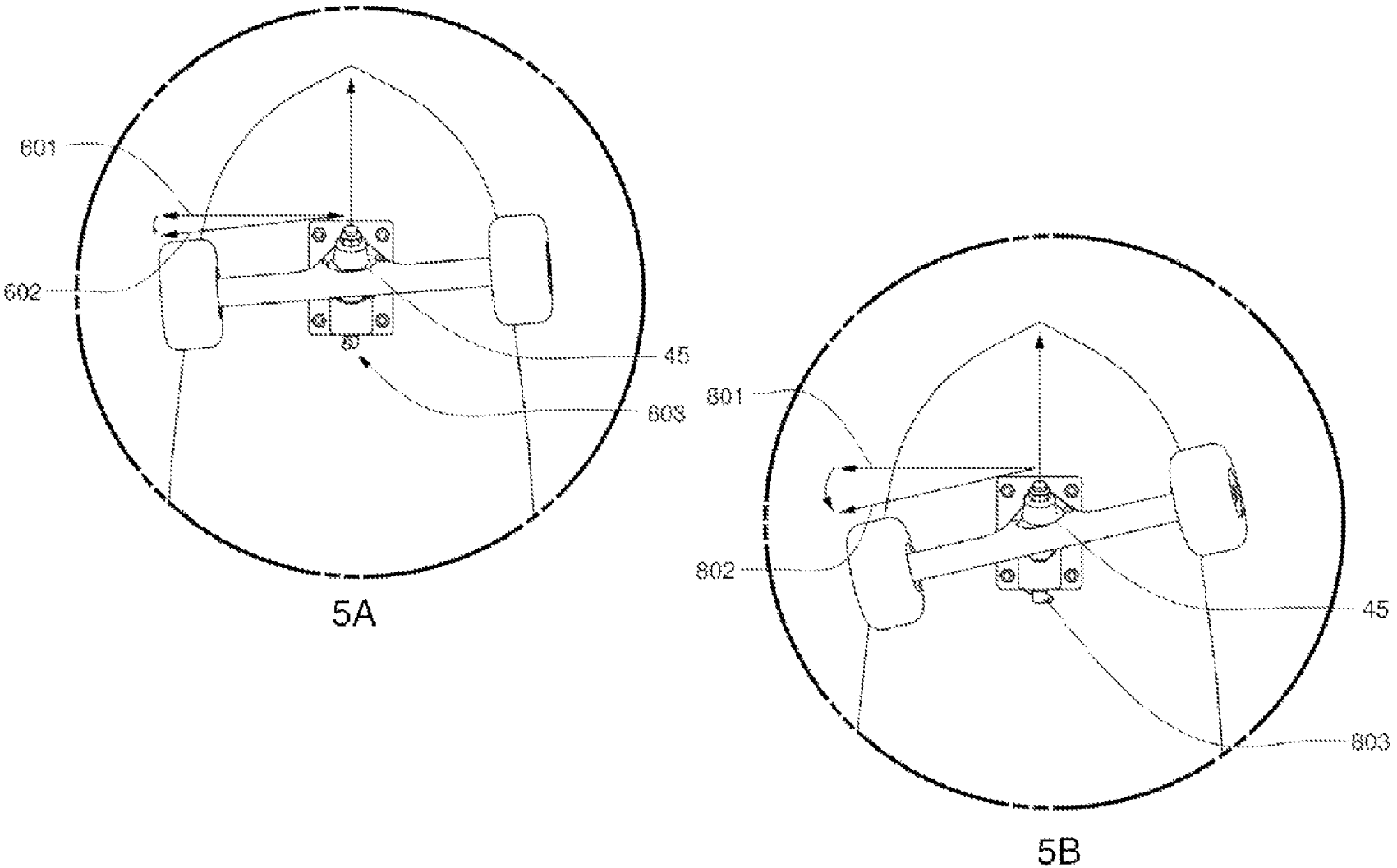
FIG. 5A is a bottom perspective view of the first embodiment of the novel skateboard truck which is seen to be attached to the front end of a skateboard deck and demonstrates the potential characteristics of truck roll and turnability when the wing shaped bushing and wing shaped washer are directed into a perpendicular bushing engagement position.
FIG. 5B is a bottom perspective view of the first embodiment of the novel skateboard truck which is seen to be attached to the front end of a skateboard deck and demonstrates the potential characteristics of truck roll and turnability when the wing shaped bushing and wing shaped washer are directed into a parallel bushing non-engaged position.

FIG. 5 is a bottom perspective view of the truck 10 of an embodiment of the present invention. In FIG. 5A, the truck is configured with a wing shaped inner bushing directed in a perpendicular engaged bushing position. Such a configuration permits a very restricted range of truck hanger turning radius as can be noted by the arrows 601 & 602 which show a potential degree of hanger rotation when the bushing is positioned in the perpendicular engaged bushing position. Even less rotation is possible if the wing bushing tips and wing washer tips are elongated even further, or if the bushing material is significantly hardened or rigid. In comparison to FIG. 5A, FIG. 5B demonstrates the highly enhanced turnability 801 & 802 of the novel truck configured with the wing tips of an inner wing shaped bushing directed into a parallel non-engaged bushing position. Moreover the turning radius comparison shown in FIGS. 5A & 5B is demonstrated through the effects of the wing shaped bushing rotation only, and not by any adjustment, increase or difference created to the bushing tension by the means of the tightening of the adjustment nut on the threaded end of the king pin stud. An angle change can be seen in the control lever switch position 603 in FIG. 5A, from the switch position 803 in FIG. 5B demonstrating one means of effecting the rotation of king pin stud, winged shaped washer and wing shaped bushing. An even greater degree of turning radius can be affected by using a softer elastomeric bushing material in the composition of the truck bushing.

Figure 6:
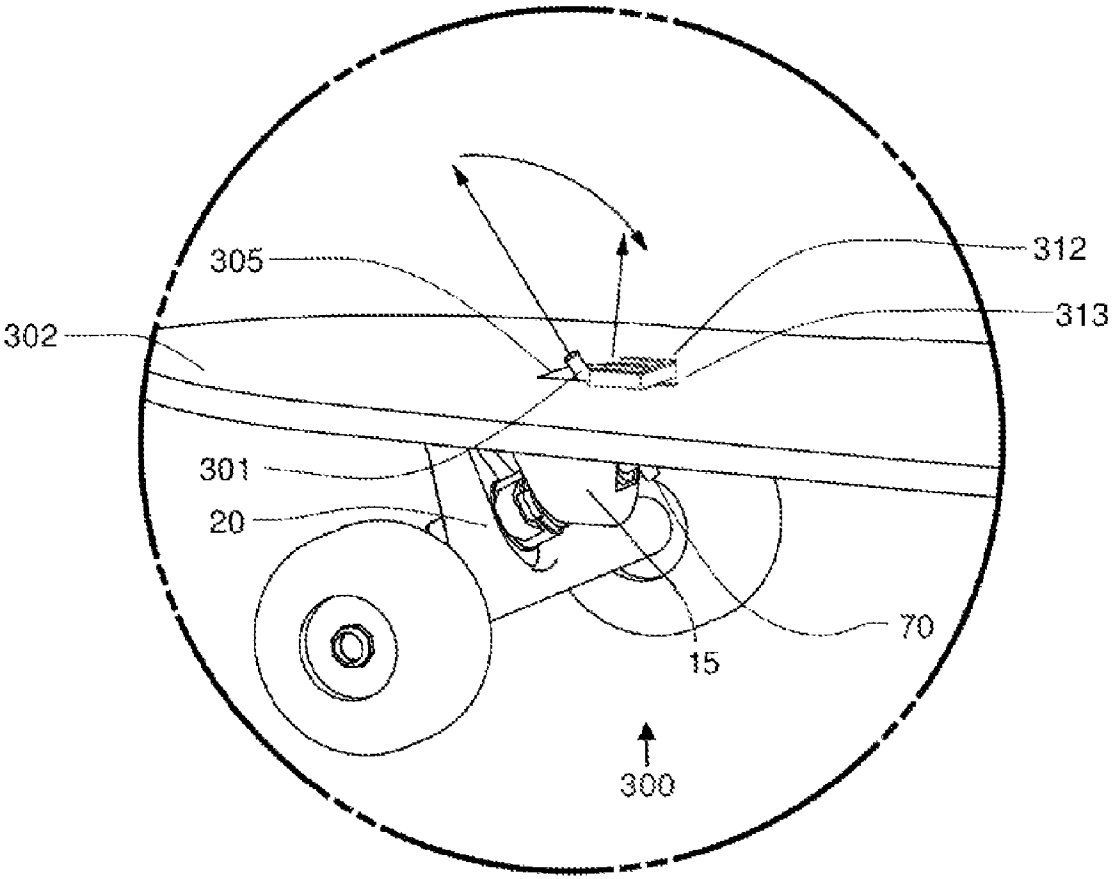
FIG. 6 is a side perspective view of an alternative embodiment detailing an extended control switch assembly which protrudes from the base plate of the truck, up and through the deck of the skateboard.

FIG. 6 is a side perspective of one end of a skateboard 300 detailing an extended end 301 of the control lever switch 70 which protrudes from the base plate 15 of the novel truck, up and through the deck 302 of skateboard 300. One type of control switch locking mechanism 312 is seen to be capable of being pushed and pulled in a guide, or track, 313 which has been cut into, or incorporated into, the deck 302 of the skateboard 300. Indentations can be viewed in the locking mechanism 312 to restrain the control switch 70 into a desired position. The position of the switch can be changed manually while a rider is mounted on and in the act of riding the skateboard. Drop through cut out 305 can provide access to other truck base plate mechanisms such as a battery pack suitable for providing power to an electrical motor, such as that shown in FIG. 8, which can be activated to effect the rotation of the wing shaped washer 22 and wing shaped bushing 11. Other suitable locking mechanisms can be utilized as required to restrain or release the lever switch 70 on novel truck 10.

Figure 7A:
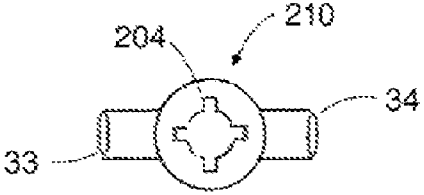
FIG. 7A details a different embodiment of winged washer incorporating bent tips and multiple hole indentations.
Figure 7:
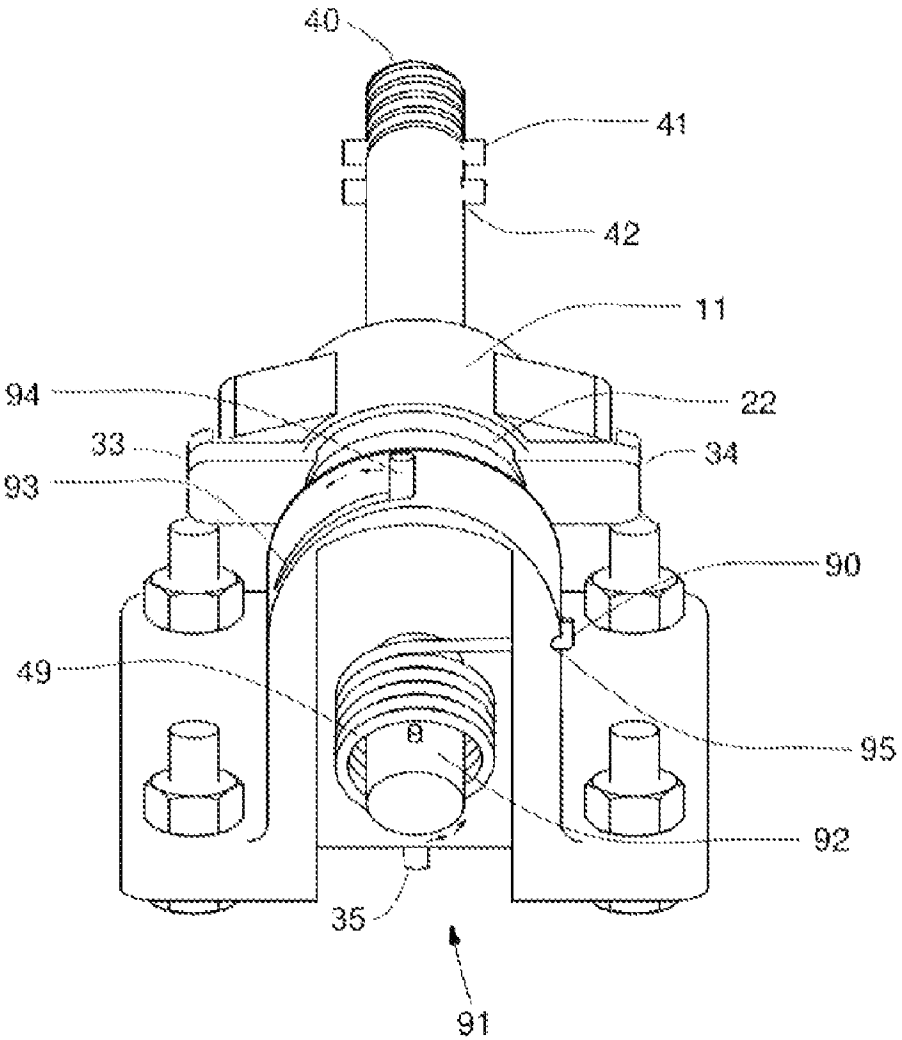
FIG. 7 is a bottom perspective view of a novel truck baseplate detailing an alternative embodiment that is configured to incorporate one type of spring loaded switch assembly capable of being utilized on the novel truck.

FIG. 7 illustrates an alternative embodiment of a novel truck baseplate 91 having one end of a spring 49 attached to an end portion 92 of the king pin stud 40 and the other end 90 of the spring 49 attached to a hole 95 in a side or other suitable place of the baseplate 91. Such a spring can provide a means for the emergency spring loaded rotation of washer 22 and bushing 11 into a predetermined position on base plate 91. A trigger slot 93 and trigger mechanism 94 can be used in conjunction with the spring mechanism so as to effect the activation from the top of the skateboard deck. Alternatively, the trigger can be activated automatically by a sensor, or by a radio control, when serious road vibrations or "wheel wobble" reach undesired or dangerous levels. Alternatively, instead of using a metal spring, a generally cubic shaped piece of resilient material such as polyurethane or rubber can be lodged in the end area of the truck baseplate 91, and engage the end portion 92 of the kingpin 40 to effect the same spring loaded functions mentioned above.

FIG. 7A details an alternate type of wing washer 210 showing elongated wing portions, multiple indentation slots 204 and upturned wing tips 33 & 34. Other suitable washer configurations or compositions can be used, such as a singly formed slotted washer and slotted bushing combinations constructed with a very hard durometer plastic material for the washer portion and a soft durometer urethane or rubber material for the bushing portion. A king pin stud, or bolt, can be configured with any of the many types of gear protrusions 41 & 42 (FIG. 7), 207 (FIG. 8) etc., suitable to effect the rotation of any suitably configured slotted or indented wing shaped washer, and/or any suitably configured slotted or indented wing shaped bushing.

FIG. 8 illustrates an alternative embodiment of a specially configured novel truck baseplate which incorporates a battery powered electric, or more particularly a "servo" type motor

200 suitable for providing enough torque to effectively rotate an alternatively configured king pin stud 211, one or more wing shaped washers 22, and one or more wing shaped bushings 11 into the desired perpendicular or parallel bushing positions. The alternative type of king pin stud 211 can be seen to be positioned such as to be capable of engaging with gear receiving slot 206 the gear drive 208 of electric motor 200. An alternative type of king pin shaft protrusion 207 can be seen to be located such that it can fit into, and 'drive' many types of outer wing shaped bushings and/or outer wing shaped washers 212 (FIG. 8A not shown to scale), the protrusions 207 being positioned near the threaded end of the king pin stud 211. Wires 209 can be seen extending out from motor 200 so as to be capable of being connected to a battery pack lodged either in the base plate 15 of the novel truck 10 or in a recess formed into skateboard deck 302. The electric 'servo' type motor 200 can be provided with a means of rotating the bushings in progressively ratcheted steps to provide either a greater or lesser degree of bushing contact with the sides 19 and 20 of hanger 14, when desired. Such ratcheting type rotation of the bushing 11 can be adjusted as needed, to offset and reduce the varying levels of 'wheel wobble' vibrations that often occur when riding a skateboard at a high rate of speed. A hand held radio control device, or switch, can also be used to activate the battery pack and 'servo' type motor 200, in order to control the ratcheting procedures in a 'remote' manner while a skateboarder is mounted on and in the act of riding the skateboard.

Figure 9:
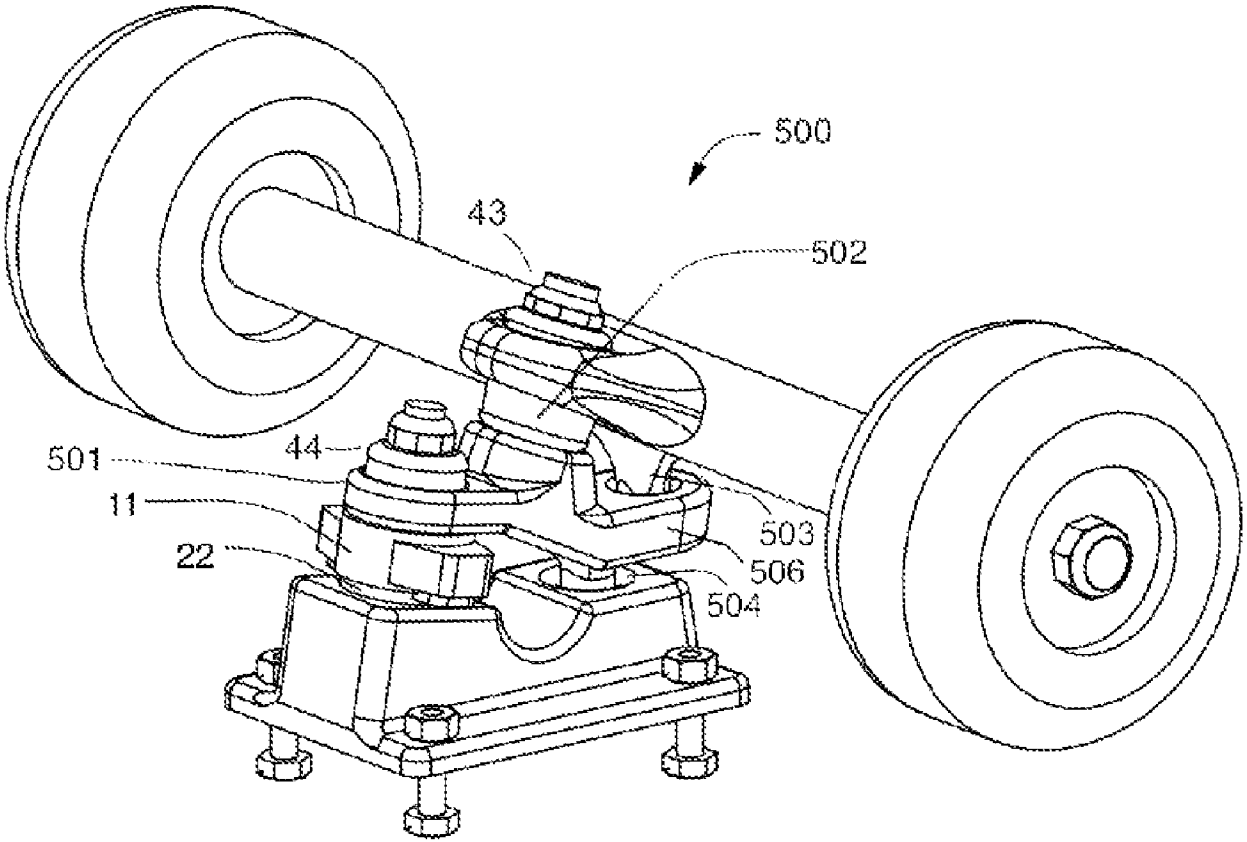
FIG. 9 is a side perspective view of an alternative embodiment demonstrating a wing shaped washer and wing shaped bushing installed onto one type of 'double pivot' skateboard truck.

FIG. 9 illustrates another alternative embodiment, among the many, of the novel truck invention, which has the capability of incorporating one or more wing shaped washers 22 and one or more wing shaped bushings 11 into a truck that comprises two pivot pins, referred to as a 'double pivot truck' such as that taught in U.S. Pat. No. 7,150,460 to Williams (December 2006).

A wing shaped washer 22 and wing shaped bushing 11 can be seen to be installed underneath the main body portion 501 of a truck insert member 506 of the 'double pivot truck' 500. Truck insert pivot 504 and hanger pivot 503 can be seen to be seated in their respective pivot receiving holes. Upper bushings can be seen to be lodged underneath their respective hex adjustment nuts 43 and restrained by their respective metal bushing retainers 44. Wing shaped washers and wing shaped bushings can be replaced, mixed or matched with regular bushings and regular washers in all bushing seats and bushing retainers on the novel truck, according to the desired level of directional stability needed for the safe riding of the skateboard. Various slip washers 46, 47 and 48 such as those shown in FIG. 4, can be utilized in the bushing seats and other locations on the novel truck, in all of its embodiments, to reduce friction in the moving components of the truck system. Flat thrust bearings, or other similar type bearings, can be used to replace any slip washer on the truck so as to reduce truck component friction to an even greater degree.

Since certain changes may be made in the above described improved skateboard truck assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

PARTS LIST

10 Skateboard Truck
11 Inner Wing Shaped Bushing
13 Wheel
14 Hanger
15 Baseplate
16 Inner Bushing Seat
17 Bushing Tip
18 Bushing Tip
19 Side Portion of Main Body
20 Side Portion of Main Body
21 Main Body of Hanger
22 Wing Shaped Washer
23 Bushing Restrainer
24 Prior Art Base Plate
25 Sloped Mounting Face
26 Pivot Pin
27 Hanger Axle
31 Pivot Pin Receiving Hole
32 Hole
33 Wing Washer Tip
34 Wing Washer Tip
35 Extended Trigger Mechanism
36 Threaded End
37 Hole
38 Hole
39 Hole
40 King Pin Stud
41 Drive Gear
42 Drive Gear
43 Adjustment Nut
44 Metal Bushing Retainer
45 Outer bushing
46 Slip Washer
47 Slip Washer
48 Slip Washer
49 Spring
70 Control Lever Switch
82 End Portion
90 Spring End
92 End Portion
93 Trigger Slot
94 Trigger Mechanism
95 Hole
96 Inner Side
97 Bolt Hex Head
99 Bushing Retainer
200 Electric Motor
201 Indentation
202 Indentation Hole
203 Hole
204 Indentation
205 Hole
206 Gear Receiving Slot
207 Shaft Protrusion
208 Gear Drive
209 electric wires
210 Alternative Washer
211 Alternative King pin Stud
212 Outer Washer
300 Skateboard
301 Extended End of Control Lever Switch
302 Skateboard Deck
305 Cut Out
312 Locking Mechanism
313 Track
500 Double Pivot Truck
501 Main Body of Insert
502 Bushing
503 Hanger Pivot
504 Truck Insert Pivot

506 Truck Insert Member
601 Arrow
602 Arrow
603 Position of Switch
801 Arrow
802 Arrow
803 Position of Switch Wherefore, I claim:

1. A skateboard truck for use in connection with a skateboard, the skateboard truck comprising:

a baseplate, a hanger and a bushing arranged between the baseplate and the hanger to provide a relative spring bias suspension between the hanger and baseplate a pin for securing the relative arrangement of the baseplate, bushing and hanger and the bushing is controllably rotatable between a first and a second position defining different suspension characteristics between the baseplate and the hanger; and wherein in one of the first and second positions the bushing applies a greater resistance against relative movement between the hanger and baseplate than in the other position.

2. The skateboard truck as recited in claim 1 wherein the bushing has a non-circular profile about the pin securing the relative arrangement of the baseplate, bushing and hanger, the non-circular profile providing greater surface area contact between the bushing and one of the hanger and the baseplate.

3. The skateboard truck of claim 1, further comprising, a control mechanism providing rotation via the pin, of the bushing between the first and second positions.

4. The skateboard truck of claim 3, wherein the control mechanism is a manually, mechanically or electrically operated control mechanism having the ability of being actuated through use of an aperture in the deck of a skateboard upon which the truck is mounted.

5. The skateboard truck as recited in claim 1 wherein the bushing has an elongate profile about the pin and in one of the first and second positions an elongate portion of the bushing provides greater surface area contact between the bushing and one of the hanger and baseplate.

6. The skateboard truck as recited in claim 5 wherein the elongate profile of the bushing comprises wings extending radially from the bushing for engaging surface portions of one of the hanger and the baseplate in the first position and being disengaged from the surface portions in the second position.

7. The skateboard truck as recited in claim 6 wherein the wings defining the elongate profile are oppositely disposed about the bushing and are controllably rotated between an angle of approximately 90 degrees between the first and second position of the bushing.

8. The skateboard truck as recited in claim 1, further comprising a washer mounted against the bushing, the washer also having a non-circular profile to provide support to the bushing and rotate with the bushing.

9. The skateboard truck as recited in claim 2, wherein the truck is a double pivot truck comprising a truck insert member arranged between the baseplate and the hanger.

10. The skateboard truck as recited in claim 9, wherein the bushing is positioned between the truck insert member and the baseplate.

11. A skateboard truck comprising:

a baseplate adapted on one side to mount to a skateboard deck;

a hanger pivotally supported on the baseplate;

a bushing resiliently secured between the hanger and the baseplate, the bushing having a central body with at least a radially extending bushing tip; and wherein the bushing is moveable between a first position with the bushing tip engaging a contact portion of the hanger to provide a stiffer suspension characteristic to the truck and a second position wherein the bushing tip is substantially unengaged with the contact portion of the hanger to provide a looser suspension characteristic to the truck.

12. The skateboard truck as set forth in claim 11 further comprising a king pin securing the hanger to the baseplate and the bushing is disposed about the king pin between the baseplate and the hanger.

13. The skateboard truck as set forth in claim 12 wherein the bushing is controllably rotated between the first and the second position to provide one of the stiffer and looser suspension characteristic to the truck.

14. The skateboard truck as set forth in claim 11 where the king pin comprises at least a protrusion adapted to engage the bushing and controllably rotate with the bushing between the first position and the second position.

15. The skateboard truck as recited in claim 11, further comprising a washer mounted against the bushing to provide support to the bushing.

16. A method of adjusting the stiffness of a skateboard suspension comprising the steps of:

arranging a bushing between a baseplate and a hanger to provide a relative spring bias suspension between the hanger and baseplate securing the relative arrangement of the baseplate, bushing and hanger with a pin;

controllably rotating the bushing between a first and a second position defining different suspension characteristics between the baseplate and the hanger; and the bushing applying in one of the first and second positions a greater resistance against relative movement between the hanger and baseplate than in the other position.

17. The method of adjusting the stiffness of a skateboard suspension as recited in claim 16 further comprising the step of providing the bushing with a non-circular profile about the pin securing the relative arrangement of the baseplate, bushing and hanger.

18. The method of adjusting the stiffness of a skateboard suspension as recited in claim 17 further comprising the step of providing a greater surface area contact between the bushing and one of the hanger and the baseplate in one of the first and second positions.

19. The method of adjusting the stiffness of a skateboard suspension as recited in claim 17 further comprising the step of forming the bushing having an elongate profile about the pin and in one of the first and second positions an elongate portion of the bushing provides greater surface area contact between the bushing and one of the hanger and baseplate.

20. The method of adjusting the stiffness of a skateboard suspension as recited in claim 17 further comprising the step mounting a washer adjacent the bushing and providing the washer also having a non-circular profile to provide support to the bushing.

* * * * *